US006914591B2

(12) United States Patent
Fukuda et al.

(10) Patent No.: US 6,914,591 B2
(45) Date of Patent: Jul. 5, 2005

(54) PANEL DRIVING DEVICE

(75) Inventors: Masao Fukuda, Fukuroi (JP); Takashi Iwami, Yamanashi-ken (JP)

(73) Assignee: Pioneer Display Products Corporation, Shizuoka-ken (JP)

( * ) Notice: Subject to any disclaimer, the term of this patent is extended or adjusted under 35 U.S.C. 154(b) by 332 days.

(21) Appl. No.: 10/176,406

(22) Filed: Jun. 21, 2002

(65) Prior Publication Data

US 2002/0196225 A1 Dec. 26, 2002

(30) Foreign Application Priority Data

Jun. 22, 2001 (JP) ..... P2001-190331

(51) Int. Cl.[7] ..... G09G 3/36
(52) U.S. Cl. ..... 345/98; 345/99; 345/100
(58) Field of Search ..... 345/98, 99, 100, 345/60; 350/350, 333; 341/100; 340/794, 798, 800

(56) References Cited

U.S. PATENT DOCUMENTS 3,942,149 A * 3/1976 Westfall, Jr. ..... 367/108
4,441,208 A * 4/1984 Iida ..... 382/245
4,844,590 A * 7/1989 Okada et al. ..... 345/97
5,227,790 A * 7/1993 Shin et al. ..... 341/100
5,886,679 A * 3/1999 Matsuda et al. ..... 345/96
6,081,303 A 6/2000 Kim
6,130,657 A 10/2000 Kurokawa et al.
6,191,768 B1 2/2001 Imamura
6,492,973 B1 * 12/2002 Kuroki et al. ..... 345/100

FOREIGN PATENT DOCUMENTS

EP 1 085 493 A2 3/2001

* cited by examiner

*Primary Examiner*—Amare Mengistu
(74) *Attorney, Agent, or Firm*—Sughrue Mion, PLLC

(57) ABSTRACT

A panel drive device is provided with: a shift register for sequentially storing address data according to second clock pulses; a latch circuit for latching the address data stored in the shift register; and a drive circuit for driving a display panel based on the address data output from the latch circuit. Supply of the second clock pulses to the shift register is interrupted after a regular timing for causing the latch circuit to latch predetermined address data stored in the shift register.

6 Claims, 6 Drawing Sheets

PANEL DRIVING DEVICE

BACKGROUND OF THE INVENTION

1. Field of the Invention

The present invention relates to devices for driving a display panel such as a plasma display panel, and more particularly to a panel driving device capable of displaying correct video images which are in accord with address data.

2. Description of Related Art

As shown in FIG. 7, a driving device for a plasma display panel 21 is provided with: a shift register 115; an address driver section 118 having a latch circuit 116 and a driver 117; a Y sustain driver 119 that outputs Y sustain pulses; and an X sustain driver 120 that outputs X sustain pulses. The output terminals of the driver 117 of the address driver section 118, Y sustain driver 119, and X sustain driver 120 are coupled to predetermined electrodes of the panel 21, respectively.

As shown in FIG. 8, address data (i.e., data items a to z) for each line are sequentially loaded to the shift register 115 according to respective clock pulses. Also, upon rise of a clock pulse for loading the last data (data item z) for the line, a latch enable signal for activating the latch circuit 116 is risen, so that the address data (data items a to z ) for the line are latched and then supplied to the driver 117 simultaneously. Then, scan pulses are selectively applied to any one of the electrodes Y1 to Yn of the panel 21, and simultaneously therewith, data pulses DP1 to DPn corresponding to predetermined address data are applied to its column electrodes D1 to Dm, to illuminate certain cells (where wall charges are stored) and leave other cells nonilluminated (where no wall charges are stored). Successively, sustain pulses are applied through the Y sustain driver 119 and the X sustain driver 120, to selectively allow only the illuminating cells to repetitively emit light.

However, as shown in FIG. 9, when noise from large power circuitry within the device enters the latch enable signal through small signal circuitry, the noise causes the latch circuit 116 to latch erroneous data. For example, as shown in FIG. 9, a stream of address data erroneously starts with a data item c to have all the data items latched as shifted, hence producing noise spots in the picture displayed on the screen of the plasma display panel 21.

SUMMARY OF THE INVENTION

An object of the invention is to provide a panel driving device which prevents production of noise spots in the picture displayed on the screen of a display panel even when noise enters small signal circuitry within the device.

A panel driving device according to the invention is provided with: a shift register (15) for sequentially storing address data according to shift clock pulses; a latch circuit (16) for latching the address data stored in the shift register (15); a drive circuit (17) for driving a display panel (21) based on the address data output from the latch circuit (16); and a clock interrupting device (12, etc.) for interrupting supply of the shift clock pulses to the shift register (15) after a regular timing for causing the latch circuit (16) to latch predetermined address data stored in the shift register (15).

According to this panel driving device, supply of the shift clock pulses to the shift register is interrupted after the regular timing for latching predetermined address data. Thus, even if predetermined address data are latched by noise after any regular timing, the predetermined address data can be latched as correctly as those latched at the regular timing. As a result, the display panel (21) can provide a display which is in accord with correct address data, without production of noise spots in the displayed picture.

There may be provided a storage device (3, 4) for storing the address data to be supplied to the shift register (15), a reading device (8) for reading the address data stored in the storage device (3, 4) to load the read address data to the shift register (15). The clock interrupting device (12, etc.) may be provided with a detecting device (12) for detecting an event in which the predetermined address data are not being read by the reading device (8), and while the detecting device (12) detects the event in which the predetermined address data are not being read, supply of the shift clock pulses to the shift register (15) may be interrupted.

In this case, supply of the shift clock pulses is interrupted while the event is detected in which the predetermined address data are not being read. Thus, even if predetermined address data are latched by noise after any regular timing, the predetermined address data can be latched as correctly as those latched at the regular timing.

The reading device (8) may output a predetermined signal indicative of the event in which the predetermined address data are not being read, and the detecting device (12) may detect the event in which the predetermined address data are not being read, based on the predetermined signal.

The clock interrupting device (12, etc.) may include a gate device (12) for selectively triggering passage of another group of clock pulses supplied to the clock interrupting device (12, etc.), as the shift clock pulses, so that the gate device (12) may select passage or nonpassage of the shift clock pulses depending on a result of detection performed by the detecting device (12).

In this case, various logic circuits may be employed as the gate device and the detecting device.

The clock interrupting device (12, etc.) may include a delay device (13) for adjusting output timing of the shift clock pulses from the gate device (12).

In this case, through timing adjustment by the delay device, the shift clock pulses can be supplied to the shift register at proper timings, respectively.

The display panel may be a plasma display panel (21).

In this case, a plasma display panel driving device which incorporates both large power circuitry and small signal circuitry together can effectively eliminate damage to any displayed picture which would be caused by the entrance of noise from the large power circuitry to the small signal circuitry.

An address driver (18) for applying data pulses to the plasma display panel (21) may also be provided to select pixels to emit light based on the address data.

In this case, the panel driving device can effectively eliminate damage to any displayed picture which would be caused by the entrance of noise to the small signal circuitry due to application of sustain pulses.

Although reference numerals are added in parentheses to the above description to facilitate the understanding of the invention, this should not be construed to limit the invention to the embodiments shown in the accompanying drawings.

DETAILED DESCRIPTION OF THE PREFERRED EMBODIMENT

Figure 1:
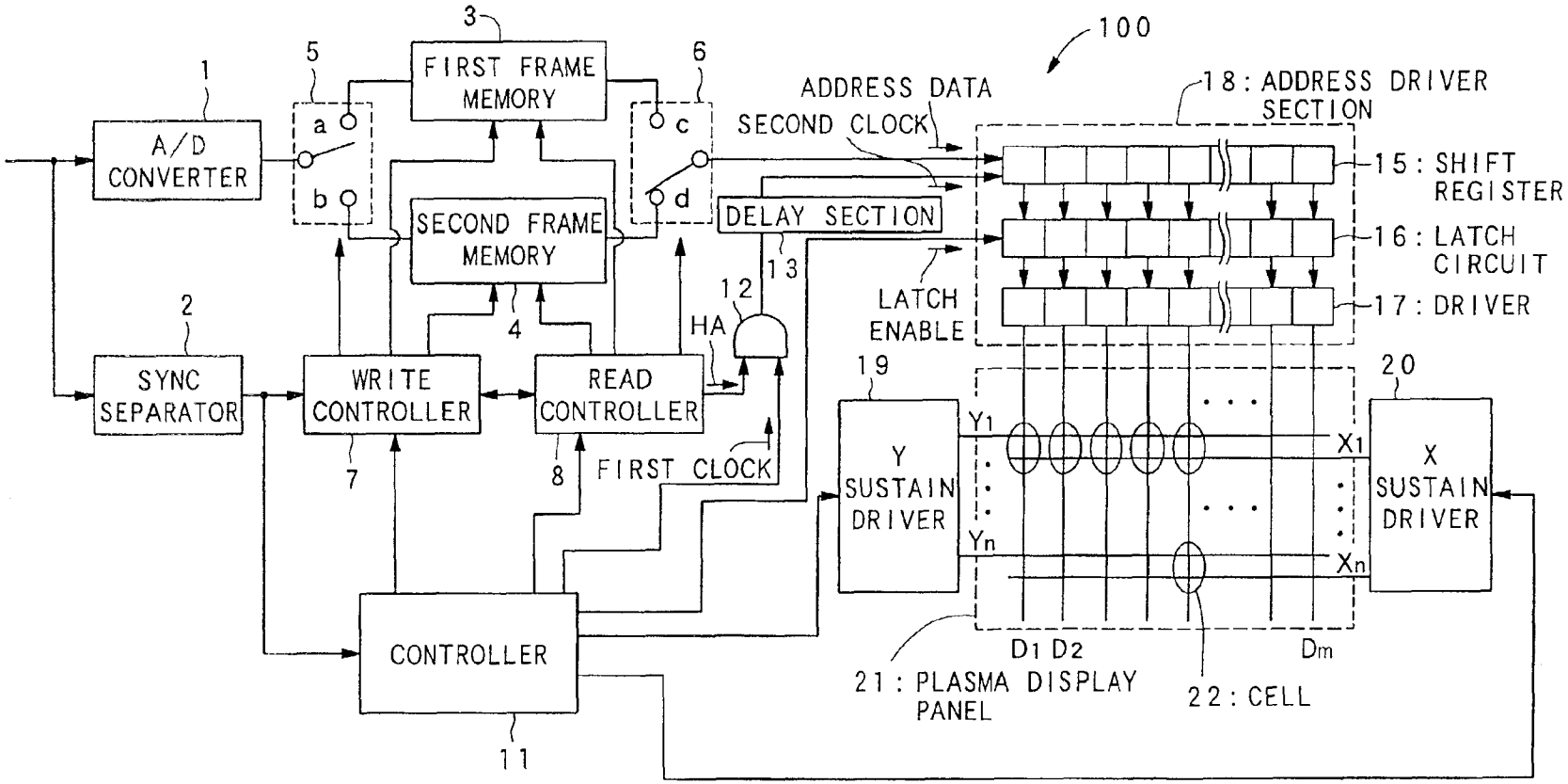
FIG. 1 is a block diagram showing a panel driving device according to an embodiment of the invention.

Referring now to FIG. 1, a panel driving device 100 according to a preferred embodiment of the invention is provided with: an analog-to-digital (A/D) converter 1 that converts an analog video signal to input video image data; a sync separator 2 that separates a sync signal from the analog video signal and outputs the separated sync signal; first and second frame memories 3 and 4 each of which stores the video image data; a write switch 5 that selects one of the frame memories to which the video image data are to be written; a read switch 6 that selects one of the frame memories from which the video image data are to be read; a write controller 7 that controls the write switch 5; a read controller 8 that controls the read switch 6; a controller 11 that controls various parts of the device; an AND circuit 12 that computes the AND of a first clock pulse from the controller 11 with a signal HA from the read controller 8; and a delay section 13 that adjusts output timing of pulses from the AND circuit 12.

The panel driving device 100 is further provided with: a shift register 15 that stores address data (pixel data) for each line; an address driver section 18 having a latch circuit 16 and a driver 17; a Y sustain driver 19 that applies Y sustain pulses to sustain electrodes Y1 to Yn simultaneously, and an X sustain driver 20 that applies X sustain pulses to sustain electrodes X1 to Xn simultaneously. The latch circuit 16 of the driver section 18 latches, after address data for each line have been loaded to the shift register 15, the address data for the line, and the driver 17 of the driver section 18 generates data pulses corresponding to the latched address data and applies the generated data pulses to column electrodes D1 to Dm simultaneously.

Figure 2:
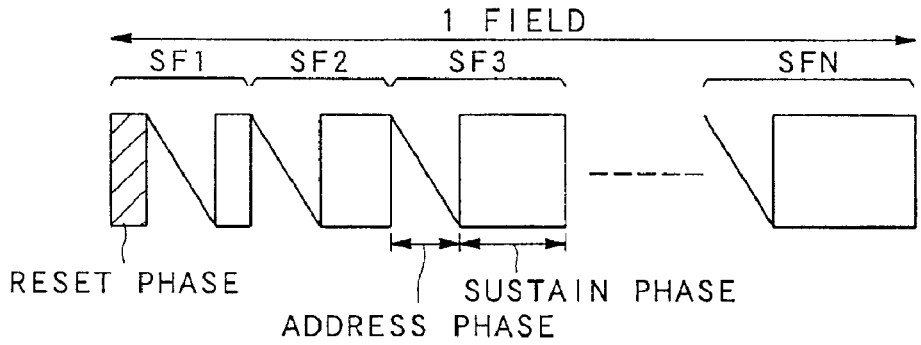
FIG. 2 is a diagram showing a drive sequence in one field interval.

In operation, the panel driving device 100 drives a plasma display panel 21 on a field interval basis. A single field interval consists of a plurality of subfields SF1 to SFN. As shown in FIG. 2, each subfield includes an address phase for selecting cells 22 to be illuminated, and a sustain phase for continuously illuminating the selected cells 22. Additionally, a reset phase precedes the first subfield SF1 to completely stop the illumination of the previous field. The durations of the sustain phases of the respective subfields are gradually increased in order of the subfields SF1 to SFN, for gray scale display.

Figure 3:
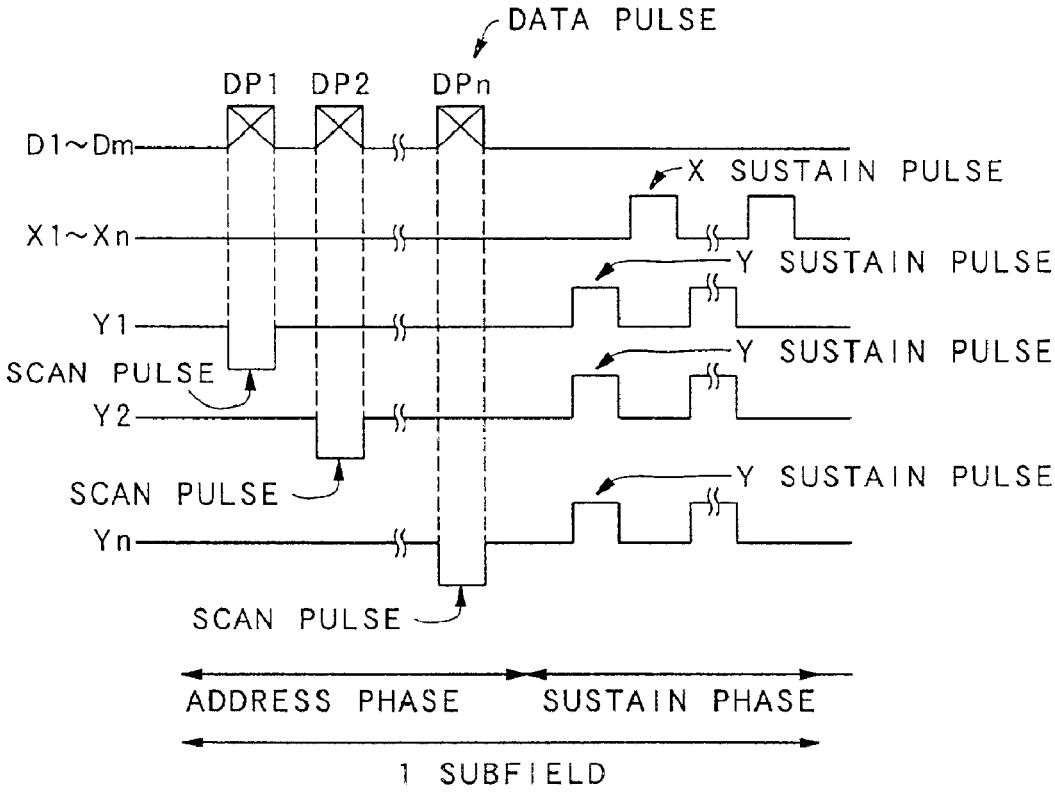
FIG. 3 is a diagram showing drive waveforms in one subfield.

Referring next to FIG. 3, during the address phase of each subfield, address scanning is performed one line at a time. That is, a scan pulse is applied to the electrode Y1 constituting a first line, and simultaneously therewith, data pulses DP1 corresponding to the address data for cells belonging to the first line are applied to the column electrodes D1 to Dm. Then, a scan pulse is applied to the electrode Y2 constituting a second line, and simultaneously therewith, data pulses DP2 corresponding to the address data for cells belonging to the second line are applied to the column electrodes D1 to Dm. Scan and data pulses are similarly applied to the third and subsequent lines, and finally, a scan pulse is applied to the electrode Yn constituting an nth line, and simultaneously therewith, data pulses DPn corresponding to the address data for cells belonging to the nth line are applied to the column electrodes D1 to Dm.

Upon completion of the above address scanning, all the cells in a subfield are either illuminating (wall charges are stored) or nonilluminating (no wall charges are stored). Every time sustain pulses are applied in the succeeding sustain phase, only the illuminating cells repeat light emission. As shown in FIG. 3, in the sustain phase, X sustain pulses and Y sustain pulses are repetitively applied to the electrodes X1 to Xn and electrodes Y1 to Yn at predetermined timings, respectively.

Figure 4:
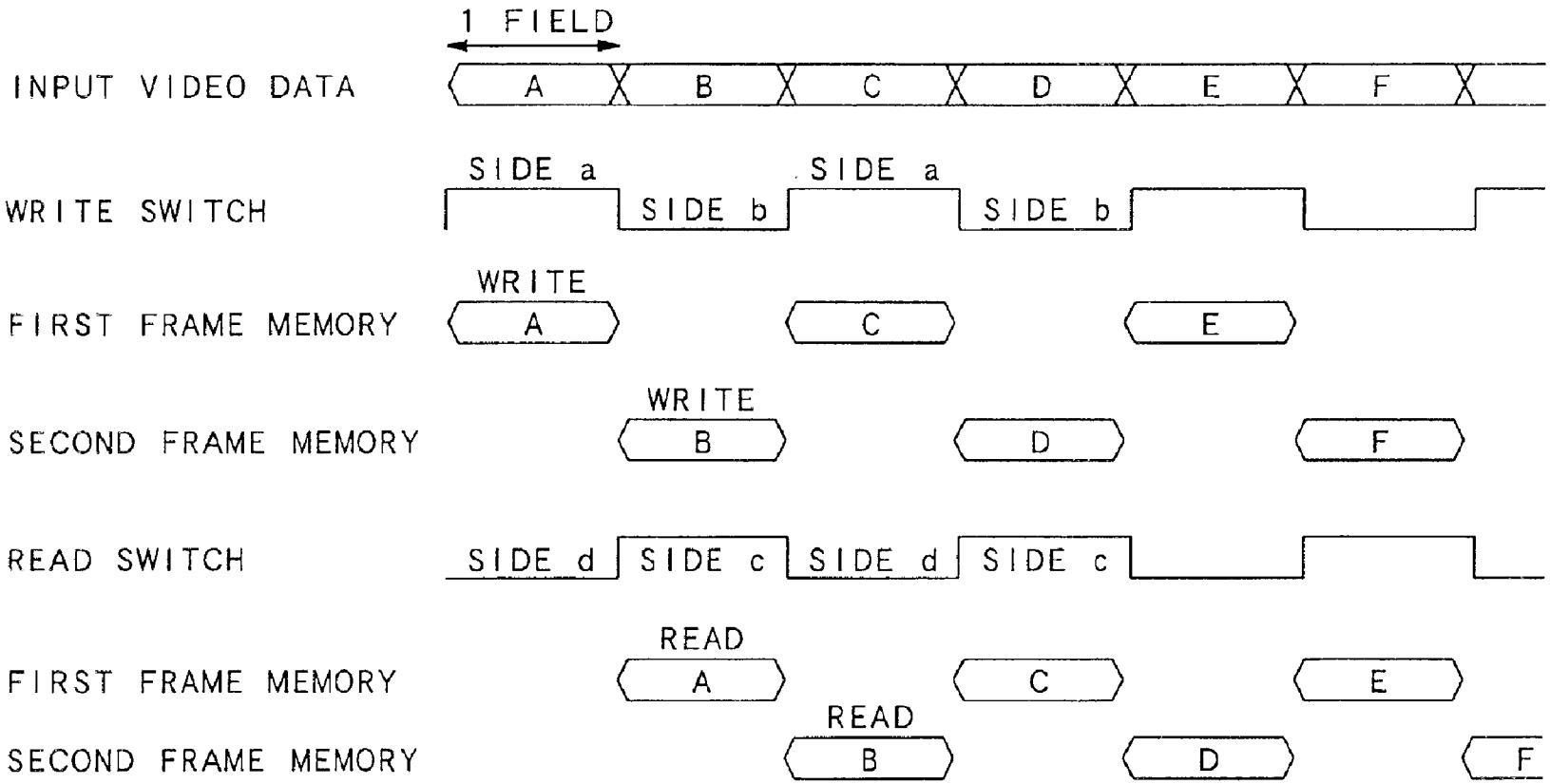
FIG. 4 is a diagram showing write and read operations to and from frame memories.

Referring now to FIG. 4, how data pulses are generated based on address data will be described. The address data from the A/D converter 1 are written, field by field, alternately to the first frame memory 3 and the second frame memory 4 as selected by the write switch 5. The input video image data in the first and second frame memories 3 and 4 are read alternately from the first and second frame memories 3 and 4 as selected by the read switch 6 one field behind that of their write timing.

Figure 6:
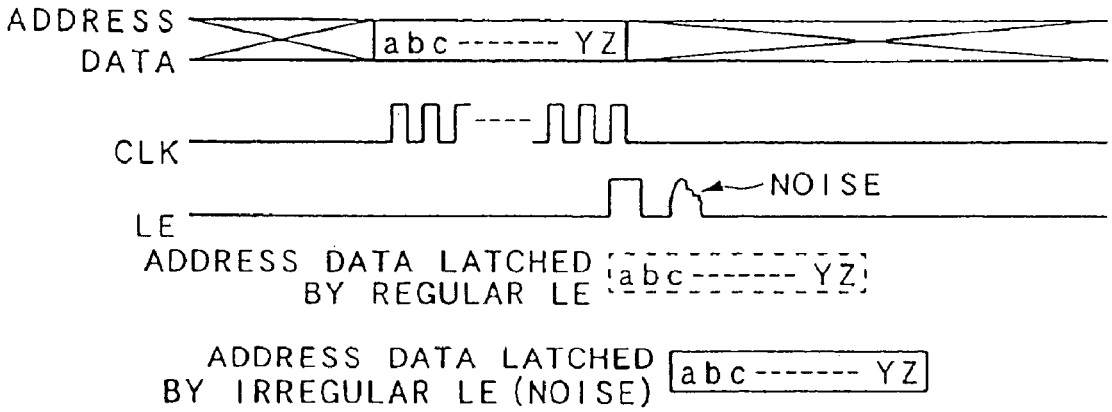
FIG. 6 is a diagram showing an operation performed by the panel driving device of FIG. 1 when noise enters a latch enable signal.
Figure 7:
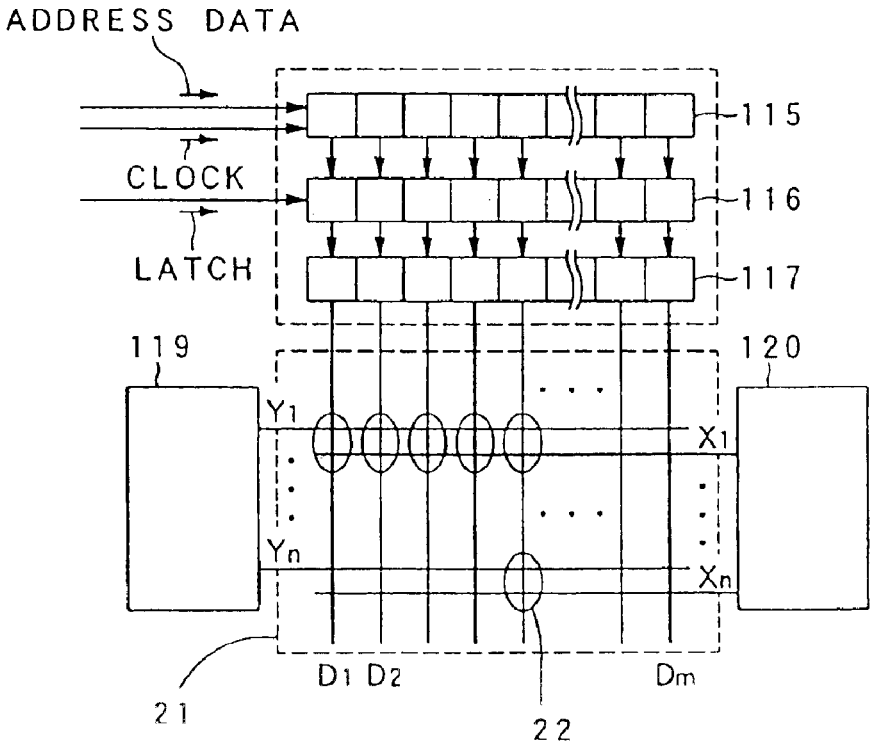
FIG. 7 PRIOR ART
FIG. 7 is a block diagram showing a prior-art panel driving device.
Figure 8:
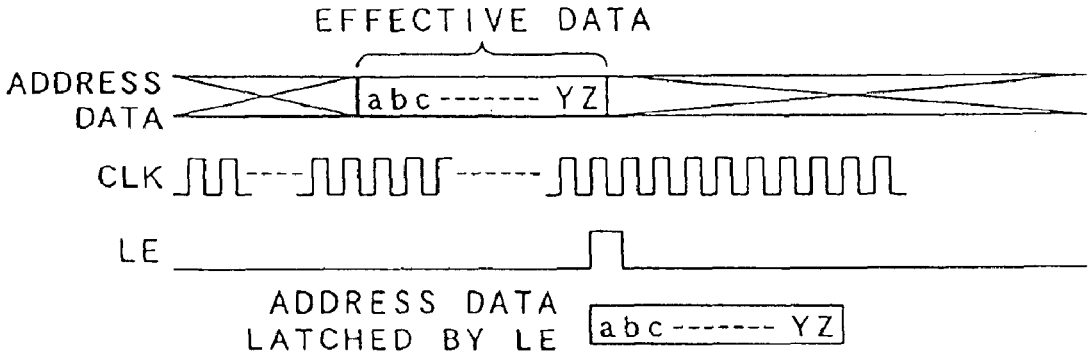
FIG. 8 PRIOR ART
FIG. 8 is a diagram showing how address data are latched.
Figure 9:
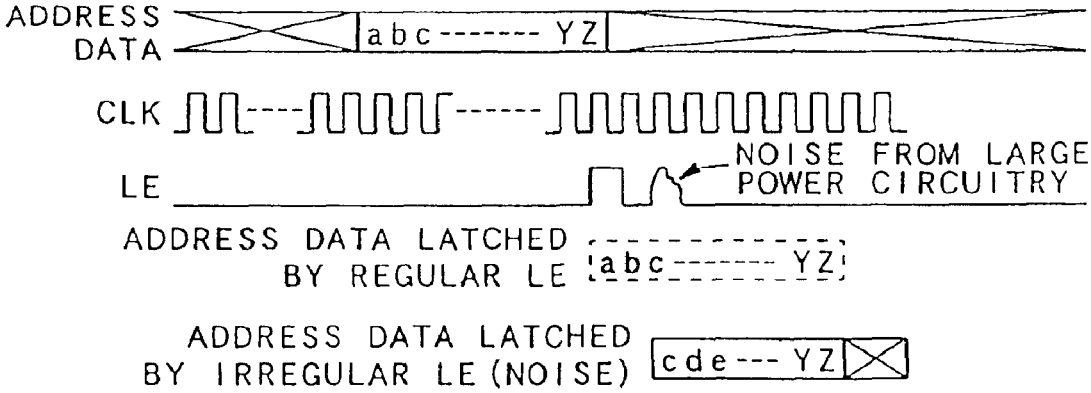
FIG. 9 PRIOR ART
FIG. 9 is a diagram showing an operation performed by the prior-art panel driving device when noise enters a latch enable signal.

The address data read from the first or second frame memory 3 or 4 are sequentially loaded to the shift register one line at a time according to respective second clock (shift clock) pulses. As shown in FIG. 6, a latch enable signal to be input to the latch circuit 16 rises upon rise of a second clock pulse for loading the last data item z for each line, and thus the address data for the line (e.g., data items a to z) are latched and then supplied to the driver 17 simultaneously. Then, a scan pulse is applied to the corresponding one of the electrodes Y1 to Yn as mentioned above, and at the same time, data pulses DP1 to DPn corresponding to the read line-based address data are applied to the corresponding column electrodes D1 to Dm.

Figure 5:
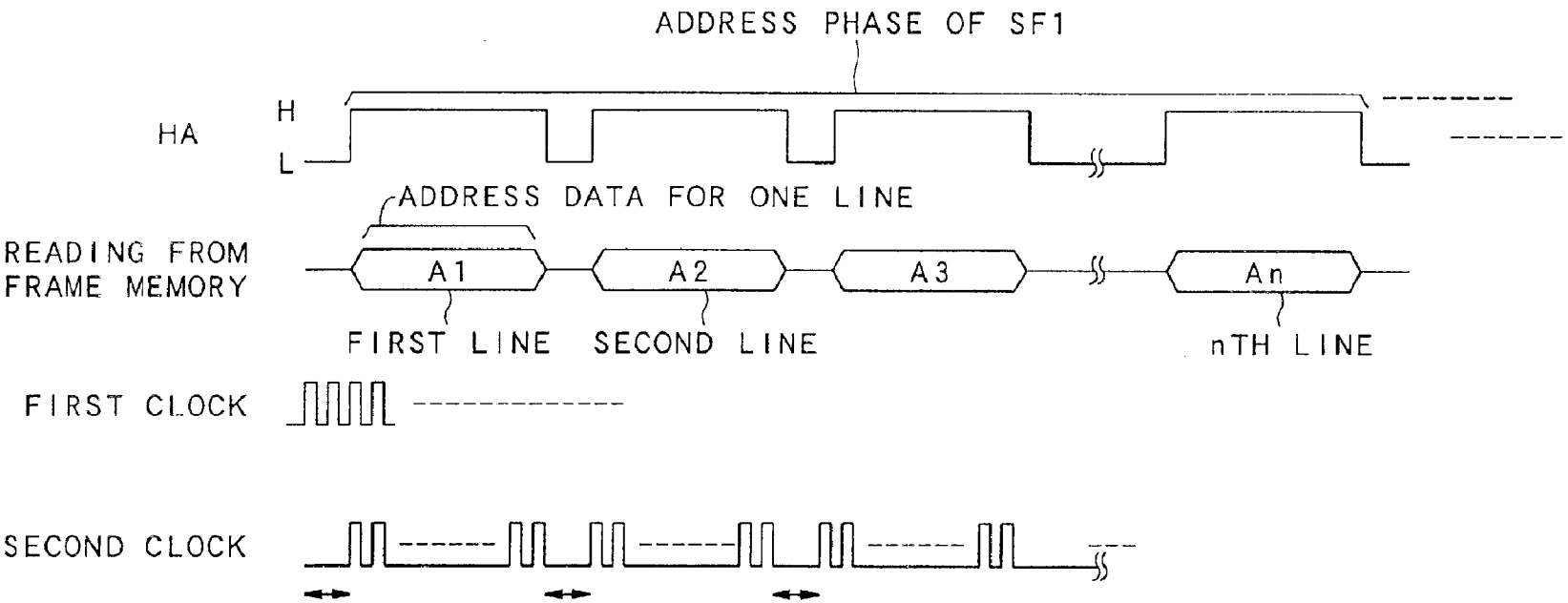
FIG. 5 is a diagram showing the read operation from a selected one of the frame memories during an address phase of a subfield.

As shown in FIG. 5, the signal HA is output from the read controller 8 while the address data are read one line at a time from the first or second frame memory 3 or 4. Referring back to FIG. 1 here, both the signal HA and each first clock pulse from the controller 11 are fed to the AND circuit 12 to trigger passage of the first clock pulse so that each of second clock pulses is output only while the signal HA is being output (the level of the signal HA is high). That is, while the address data are not read from the first or second frame memory 3 or 4, no second clock pulses are output. Each second clock pulse passes through the delay section 13 to have its timing adjusted before output to the shift register 15.

Thus, in this embodiment, there is a pause in the supply of second clock pulses whenever there is a pause in reading address data for each line from one of the frame memories, and this means that the shift register 15 keeps its data unupdated during each pause, to keep therein the address data which have been correctly read upon rise of the last regular latch enable signal. As a result, as shown in FIG. 6, even if noise from large power circuitry is accidentally superimposed upon the latch enable signal, the data latched by the noise is as correct as address data read by the regular latch enable signal. Therefore, even if address data are latched at an abnormal timing by noise, the address data can be read correctly, to supply the plasma display panel 21 with data pulses which are in accord with the correctly read address data, and hence the picture displayed on the panel 21 includes no noise marks.

As described in the foregoing, according to the panel driving device of the invention, supply of shift clock pulses to the shift register is interrupted after each regular latch timing for reading predetermined address data. Thus, even if the latching of address data is triggered by noise after a regular timing, the device keeps latching correct address data. As a result, the display panel provides a display which is in accord with the correct address data on its screen, with no noise marks present in the picture displayed on its screen.

The entire disclosure of Japanese Patent Application No. 2001-190331 filed on Jun. 22, 2001 including the specification, claims, drawings and summary is incorporated herein by reference in its entirety.

What is claimed is:

1. A panel driving device comprising:

a shift register for sequentially storing address data according to shift clock pulses;

a latch circuit for latching the address data stored in the shift register;

a drive circuit for driving a display panel based on the address data output from the latch circuit; and a clock interrupting device for interrupting supply of the shift clock pulses to the shift register after a regular timing for causing the latch circuit to latch predetermined address data stored in the shift register a storage device for storing the address data to be supplied to the shift register; and a reading device for reading the address data stored in the storage device to load the read address data to the shift register, wherein the clock interrupting device includes a detecting device for detecting an event in which the predetermined address data are not being read by the reading device, and interrupts supply of the shift clock pulses to the shift register while the detecting device detects the event in which the predetermined address data are not being read.

2. The panel driving device according to claim 1, wherein the reading device outputs a predetermined signal indicative of the event in which the predetermined address data are not being read, and the detecting device detects the event in which the predetermined address data are not being read, based on the predetermined signal.

3. The panel drive device according to claim 1, wherein the clock interrupting device includes a gate device for selectively triggering passage of another group of clock pulses supplied to the clock interrupting device, as the shift clock pulses, so that the gate device selects passage or nonpassage of the shift clock pulses depending on a result of detection performed by the detecting device.

4. The panel driving device according to claim 3, wherein the clock interrupting device includes a delay device for adjusting output timing of the shift clock pulses from the gate device.

5. The panel driving device according to claim 1, wherein the display panel is a plasma display panel.

6. The panel driving device according to claim 5, further comprising an address driver for applying data pulses to the plasma display panel to select pixels to emit light based on the address data.

* * * * *

UNITED STATES PATENT AND TRADEMARK OFFICE

CERTIFICATE OF CORRECTION

PATENT NO. : 6,914,591 B2
APPLICATION NO. : 10/176406
DATED : July 5, 2005
INVENTOR(S) : Masao Fukuda and Takashi Iwami It is certified that error appears in the above-identified patent and that said Letters Patent is hereby corrected as shown below:

On the Title Page (73) under Assignee:

Please insert: Pioneer Corporation, Tokyo (JP); Pioneer Display Products Corporation, Shizuoka-Ken, (JP)

Signed and Sealed this

Twenty-third Day of September, 2008

JON W. DUDAS
*Director of the United States Patent and Trademark Office*